United States Patent [19]

Moore et al.

[11] 4,263,854

[45] Apr. 28, 1981

[54] CUTTING TABLE STORAGE MECHANISM

[75] Inventors: Danniel A. Moore, Freehold, N.J.; Cristian J. Felix, Flushing, N.Y.

[73] Assignee: The Singer Company, Stamford, Conn.

[21] Appl. No.: 73,962

[22] Filed: Sep. 10, 1979

[51] Int. Cl.[3] ..... A47B 3/00

[52] U.S. Cl. ..... 108/37; 108/40; 108/68

[58] Field of Search ..... 108/37, 40, 68, 67; 312/317 R, 317 A, 241

[56] References Cited

U.S. PATENT DOCUMENTS

| | | | |
|---|---|---|---|
| 419,978 | 1/1890 | Taylor | 108/68 X |
| 542,139 | 7/1895 | Brodin | 108/68 |
| 574,759 | 1/1897 | Pickett | 108/68 X |
| 1,272,983 | 7/1918 | Menzo | 108/67 X |
| 1,457,751 | 6/1923 | Roberts | 108/40 X |
| 1,568,228 | 1/1926 | Lippert | 108/40 |
| 1,595,548 | 8/1926 | Hogan et al. | 108/37 |
| 1,699,496 | 1/1929 | Wasmuth | 108/40 |
| 1,968,744 | 7/1934 | Clark | 108/37 X |
| 2,536,366 | 1/1951 | Harris et al. | 108/37 |
| 2,548,437 | 4/1951 | Mantagas | 312/317 R |

*Primary Examiner*—Francis K. Zugel

*Attorney, Agent, or Firm*—James M. Trygg; Robert E. Smith; Edward L. Bell

[57] ABSTRACT

A storage cabinet containing a folding cutting table of the type having hingedly connected table top panels which may be extended to form a flat continuous table surface or folded into a relatively compact, stacked assembly and stored within the cabinet.

2 Claims, 6 Drawing Figures

CUTTING TABLE STORAGE MECHANISM

BACKGROUND OF THE INVENTION

Cutting tables designed specifically to aid in cutting and otherwise preparing materials to be sewn are fairly uncommon. Such tables when used in the home must be able to be folded and stored into a compact structure. Typically these tables are either too small, or if the table surface is large enough, the storage cabinet is too bulky. An example of the latter type is disclosed in U.S. Pat. No. 1,363,062, Dec. 21, 1920, Steere. Steere discloses a cabinet having sides hinged together such that the cabinet sides and top unfold into a rather long but narrow table surface. The table surface is supported on four stationary legs with a pull-out platform integrated into the base. The resulting work surface then consists of five segments attached to the base. Due to its long narrow characteristics, this table is not suitable for preparing and cutting materials to be sewn. U.S. Pat. No. 2,655,420, Oct. 13, 1973, Hedley discloses a cabinet having two front doors. The table work surface is folded in half and stored horizontal to the floor and forms the top of the cabinet which consists of three layers. Two of the layers are hinged together for unfolding and forming a table top work surface, the other layer is hinged such that it folds down and becomes a support leg. The extended table top surface then may be pivoted 90° from the stationary cabinet which supports its other end. With this structure, the table surface may be made large enough for use as a cutting table, however, the base must be at least one half the size of the table work surface resulting in a relatively large base cabinet. U.S. Pat. No. DES. 181,286, Oct. 29, 1957, Gaines discloses a combined desk extension table. The structure very closely resembles a desk having three drawers on the left hand side and a full width panel directly under the desk top, having two support legs attached thereto and two hand pulls. There is a telescoping channel frame one end of which is attached to the desk, the other end being attached to the full width panel such that when the full width panel is pulled out away from the desk the telescoping frame members are extended and provide a support surface for a flexible table top which is stored within the desk. While his structure permits a relatively large table work surface which may be stored in a relatively compact unit, it has the disadvantage inherent in such table tops in that the work surface must be made of a flexible material resulting in a non-rigid yielding surface. U.S. Pat. No. 2,004,896, June 11, 1935, Knogg discloses a folding table consisting of three segments hinged together to form a table surface and a storage cabinet designed to support one end of the extended table surface. The cabinet will house the folded table elements when not in use. The three table elements when extended are locked in position by braces which are pivotally mounted to the underside of two of the table elements. The free end of the table surface is supported by a front panel. When storing, the table surface and front panel are simply pushed towards the cabinet and the table surface elements then fall into a curved compartment internal to the cabinet being free to flex at their hinge points. When the table surface is completely stored within the compartment, two of the table elements are substantially vertical, the third being substantially horizontal. Two fold out benches are hingedly attached to the front panel. The length of the table in this structure, however, is limited to the height plus the depth of the storage compartment. U.S. Pat. No. 2,652,305, Sept. 15, 1953, Swedman discloses a service door mechanism for a refrigerator display case. The service door, when closed, assumes a position substantially vertical to the floor. The door has attached to its top center a cable which attaches at its other end to a spring bias mechanism for exerting an upward pressure to counterbalance the weight of the door for ease in opening. There is a substantially horizontal track along the top at each end of the cabinet for rollers which are attached to the ends of the service door for guiding the top edge of the service door as it is being opened. Approximately midway at each end of the service door are mounted rollers which ride in a second track designed to allow the lower edge of the door to be pulled up and out as the top edge of the door recedes into the display case. While Swedman does not disclose a cutting table, he does disclose a counterbalance and guide track means for the service door which could possibly be adapted for use with a folding cutting table.

The above citations comprise what the applicant believes to be the closest art of which he is aware that may be relevant to the examination of this application.

SUMMARY OF THE INVENTION

The present invention overcomes these difficulties of the prior art by providing a folding cutting table which may be stored vertically in a compact cabinet. Compact cabinet, as used herein, is defined as follows: the depth of the compact cabinet is substantially less than the actual length of the cutting table as measured when folded and ready for storage within the cabinet. It is therefore an objective of this invention to provide a mechanism for folding a substantially large cutting table and storing it in a relatively compact cabinet. It is a further objective of this invention to provide a novel mechanism for counterbalancing the weight of the folded and stored cutting table and a guide mechanism for guiding the table while it is being stored or extended for use. Other objectives and advantages of the invention will become apparent through reference to the accompanying drawings and descriptive matter which illustrate a preferred embodiment of the invention.

According to the present invention, there is provided a storage cabinet having a folding cutting table of the type having hingedly connected table top panels. The panels are selectively positionable into extended relation for providing a substantially flat and continuous table surface, or into folded relation wherein the panels are substantially parallel and form a stacked assembly. Support means is provided for sustaining the table top panels when in extended relation. There is a transport means comprising:

a. pivot means associated with one of the panels, and b. guide means for selectively positioning the pivot means in one of two locations. The first location being at a level suitable for the position of the panels when in extended relation, and the second location arranged at a distance vertically beneath the level of the first location and being suitable for the position of the panels when folded into a stacked assembly and disposed in a substantially vertical compact arrangement.

Compact arrangement, as used herein, is defined as follows: the folding cutting table having each of its table panels folded flat against each other such that they may be enclosed, as a unit, in a rectangular parallelepiped of volume substantially equal to or slightly greater than the sum of the volumes occupied by the individual table panels.

DESCRIPTION OF THE DRAWINGS

The invention, both as to its construction and to its method of operation, together with additional objects and advantages thereof, would be best understood upon reading the following detailed description of the invention with reference to the accompanying drawings, in which.

PREFERRED EMBODIMENT OF THE INVENTION

Figure 1:
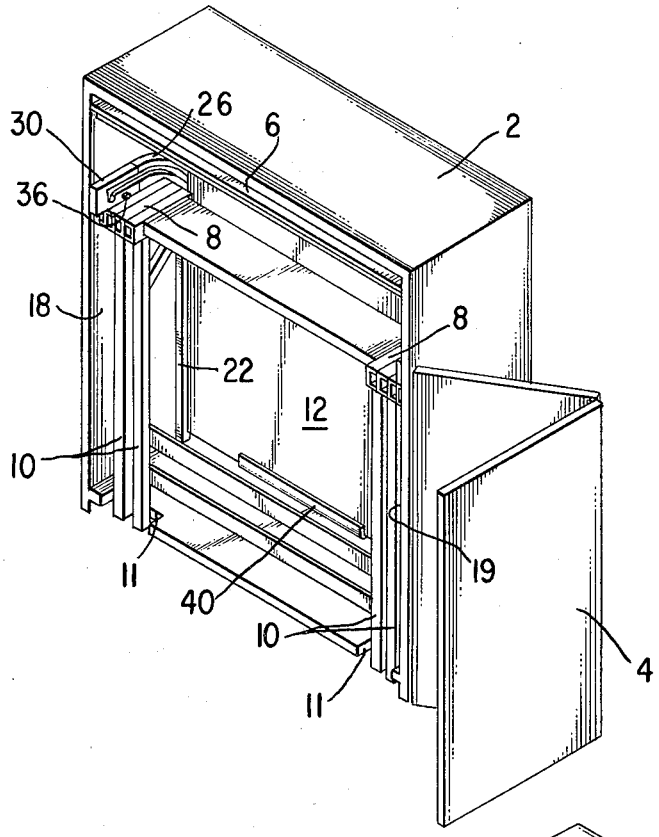
FIG. 1 is a perspective view of the folded cutting table in a stored position.
Figure 2:
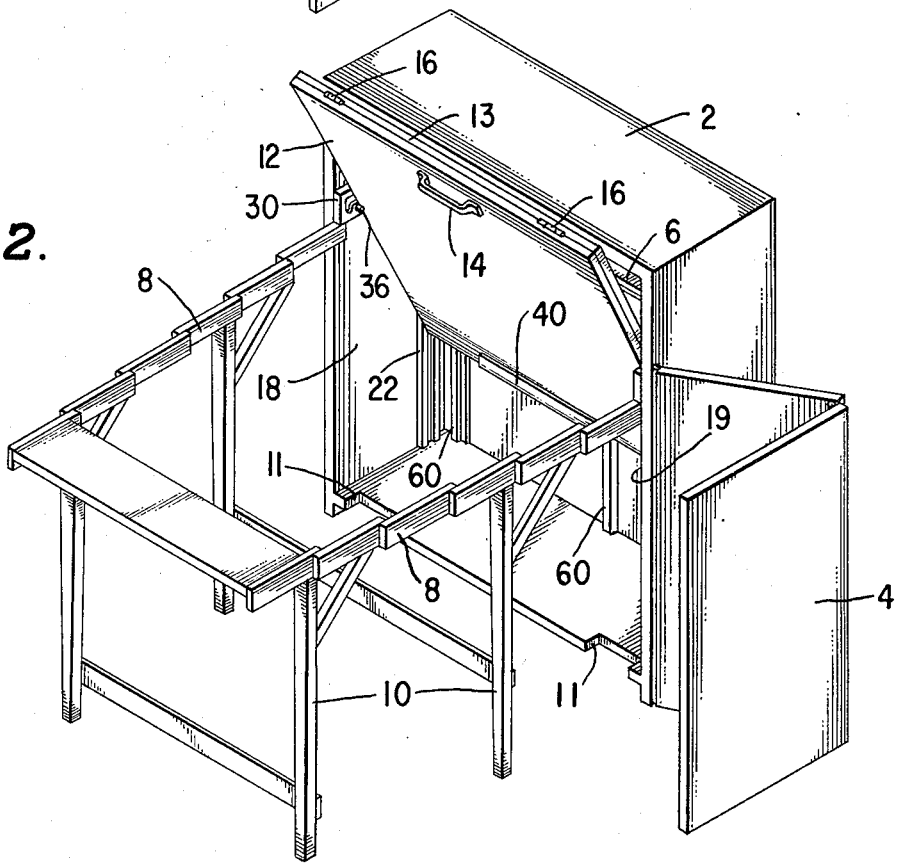
FIG. 2 is a perspective view similar to FIG. 1 showing the support frame in its extended position and the folded cutting table partially raised and tilted forward.
Figure 3:
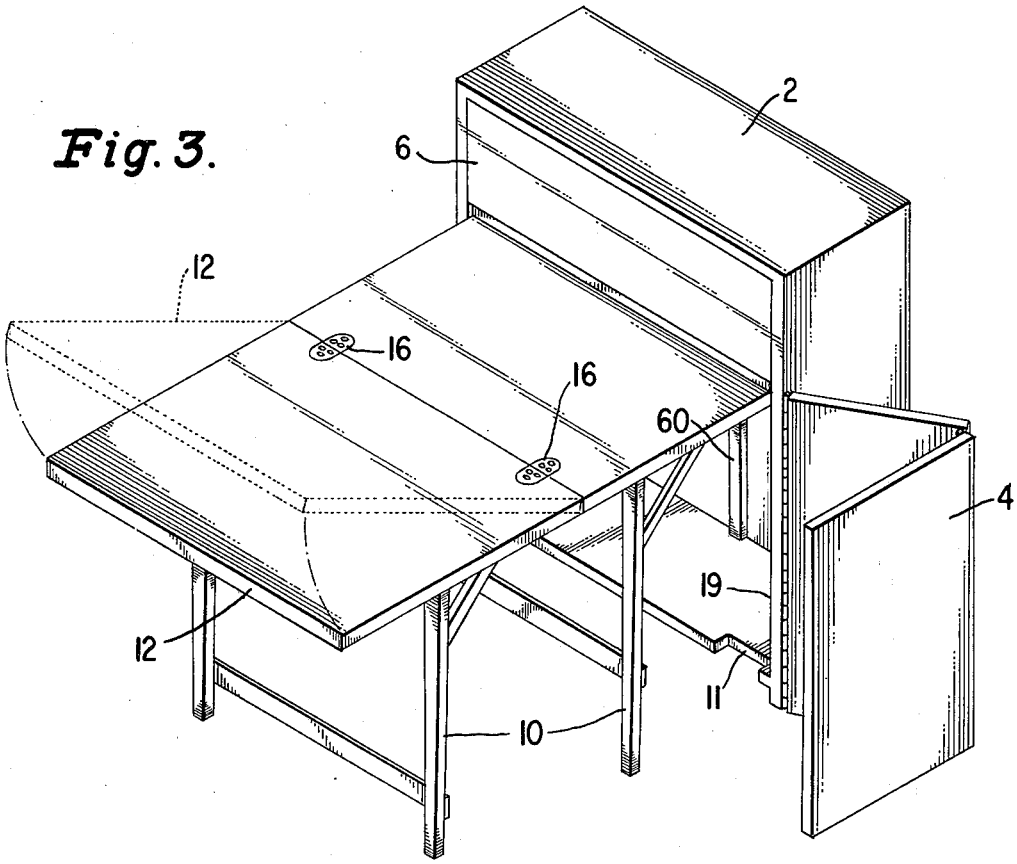
FIG. 3 is a perspective view similar to FIG. 2 with the cutting table completely extended.
Figure 4:
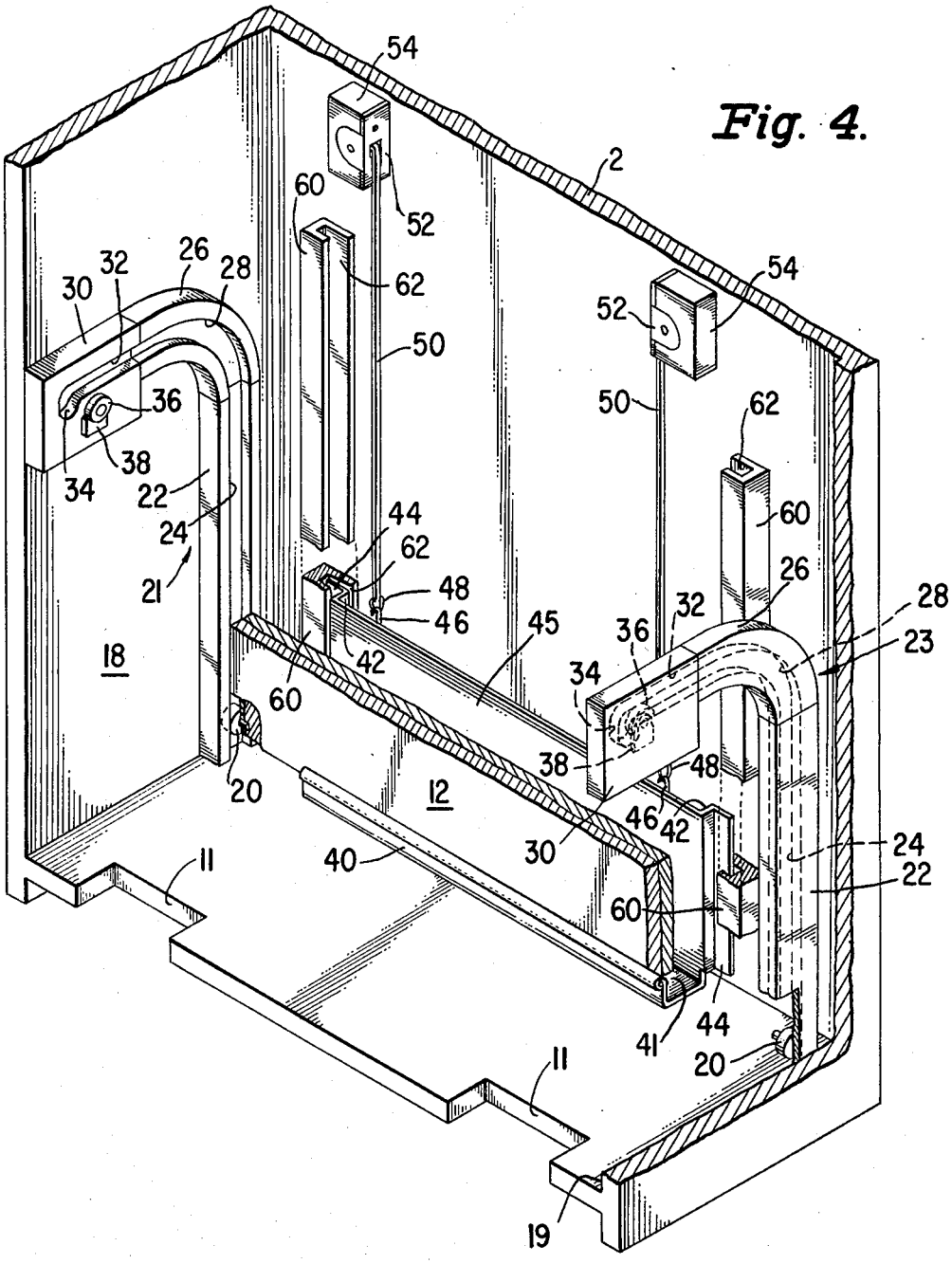
FIG. 4 is a partial perspective view of the invention showing the guide tracks and the counterbalance means.

Referring to FIGS. 1, 2, and 3 there is shown a cutting table cabinet 2 having a bi-fold door 4 hingedly attached thereto for covering the lower three-fourths of cabinet 2. A swing down door 6 covers the upper one-fourth of cabinet 2 and is mounted such that it may be stored in a horizontal position in the top portion of the cabinet 2. As shown in FIG. 1 a table support frame 8 having collapsible side members consisting of telescoping U-channels and support legs 10 may be completely stored within the interior of cabinet 2. The cutouts 11 in cabinet 2 are provided to accommodate the legs 10 when in their stored position. Referring to FIG. 2 the collapsible table support frame 8 is shown in its fully extended position. Cutting table 12 consists of two halves folded flat together in their stored position and hingedly attached along a common edge 13 by hinges 16. A pull handle 14 is rigidly attached to the cutting table 12 adjacent to the common edge 13 positioned for convenient operator access for moving the cutting table 12 from and to its stored position. Referring to FIG. 4, there is a guide track generally indicated by 21, rigidly mounted to the interior left wall 18 and a similar guide track of mirror image indicated by 23, mounted to the right wall 19 of the cabinet 2 for controlling the motion of the cutting table 12 as it is being moved from and to its stored position. The guide tracks 21 and 23 comprise vertical guide members 22 having vertical guide tracks 24, horizontal guide members 30 having horizontal guide tracks 32, and arcuate guide members 26 having arcuate guide tracks 28 which form a smooth transition between the horizontal tracks 32 and vertical tracks 24. A roller 20 is rotatably supported at each side of the lower extremity of cutting table 12 for operational engagement with vertical tracks 24. A bracket 38 having a second guide roller 36 rotatably mounted thereto is rigidly mounted to the horizontal member 30 of each track 21 and 23 in position to support and guide the cutting table 12 as it is moved from and to its stored position. A detent 34 is formed in a lower surface of the extremity of each of the horizontal tracks 32 such that when cutting table 12 is fully extended the first guide rollers 20 will rest in the detents 34 allowing the support frame 8 to support substantially all of the weight of the table 12. A lift cradle 40, for partially counterbalancing the weight of the cutting table 12, has a U-shaped lower portion for loosely receiving and supporting the lower extremity of the cutting table 12 when the cutting table is folded and placed in its stored position. In this stored position, the lift cradle 40 must overcome something less than the entire weight of the cutting table 12 to assure that the cutting table will remain in its stored position without the need for a constraining device. The lift cradle 40 has a higher back portion 45 running for substantially its entire length and has formed at its extremities right angle portions 42 and offset guide ears 44. Two retaining members 60, each having a retaining track 62, are rigidly mounted to the rear wall of the cabinet 2 such that the offset guide ears 44 operationally engage the retaining tracks 62 for guiding the vertical movement of the lift cradle 40. There are two sash counterbalance mechanisms 52 rigidly mounted to the mounting blocks 54 which in turn are rigidly mounted to the rear wall of cabinet 2. Each sash counterbalance 52 has a tape 50 which extends downwardly and is attached to the high back 45 of the lift cradle 40 by means of the attaching rings 48 and the hooks 46 which are rigidly attached to the high back 45. The sash counterbalance mechanism 52 exerts sufficient force through the tape 50 to the lift cradle 40 to counterbalance most but not all of the weight of cutting table 12 when it is in its folded and stored position.

Figure 5:
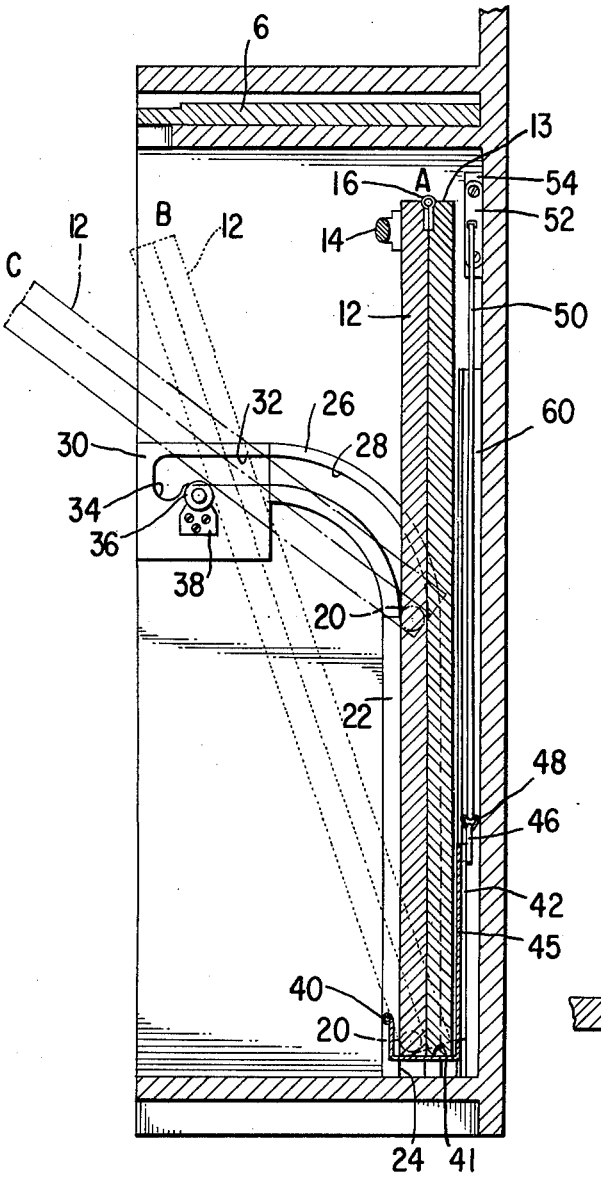
FIG. 5 is a sectional elevation view showing the cutting table in its stored position represented by A. The table is shown tilted forward in broken lines at B and it is shown partly extended in broken lines at C.
Figure 6:
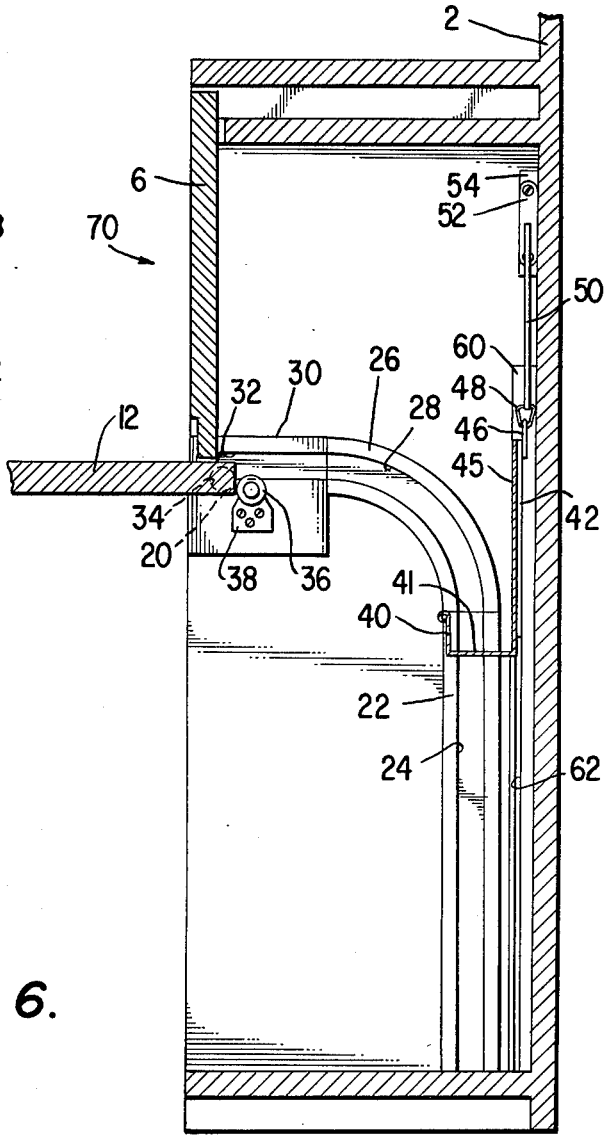
FIG. 6 is a sectional elevation view similar to FIG. 5 with the folded cutting table fully extended and the lift cradle in its fully up position.

In operation, referring to FIGS. 5 and 6, the cutting table is shown in its folded and stored position A. As it is pulled forward by handle 14 to position B, indicated by dotted lines, the under surface of cutting table 12 engages the second guide rollers 36, while first guide rollers 20 are located in the lower extremity of the vertical guide tracks 24. As slight upward pressure is applied to the handle 14 the folded cutting table 12 begins to move upward due to the upward force of the lift cradle 40 and tilt out as the first guide rollers 20 rise in the vertical tracks 24 and the under surface of cutting table 12 is partially supported by and rolls on the second guide rollers 36 to the position indicated by C. As the cutting table 12 is moved from position B to position C, its weight is gradually shifted from the lift cradle 40 to the second guide rollers 36 until the lift cradle 40 is supporting only its own weight. This results in an approximately linear change in the downward force applied to the lift cradle 40 due to the weight of cutting table 12 which closely corresponds to the change in lifting force exerted by the sash counter balance mechanisms 52 as the lift cradle 40 moves upward. As movement continues the first guide rollers 20 move into the arcuate tracks 28 and then into the horizontal tracks 32 and finally engage detents 34 at which time the folded cutting table 12 is in a horizontal position and its lower extremity resting on the table support frame 8. The upper half of the cutting table 12 is then pivoted about the hinges 16 and positioned fully extended against the table support frame 8 to form a flat and continuous table surface. The door 6 is then pulled out and swung down into position as indicated at 70 in FIG. 6. The lift cradle 40 assumes an unloaded rest position just below the lower extremity of the arcuate tracks 28.

We claim:

1. In a storage cabinet having a folding cutting table of the type having hingedly connected table top panels, said panels, being selectively positionable into extended relation for providing a substantially flat and continuous table surface, or into folded relation wherein said panels are substantially parallel and form a stacked assembly, support means including support leg means for sustaining said table top panels when in said extended relation and transport means comprising:

a. a roller rotatably attached to one of said panels, b. a track for guiding movement of and selectively positioning said roller in one of two locations, the first of said locations being at a level suitable for the position of said panels when in said extended relation and the second of said locations arranged at a distance vertically beneath the level of said first of said locations and being suitable for the position of said panels when folded into said stacked assembly and disposed in a substantially vertical compact arrangement, c. a second roller rotatably attached to said storage cabinet for partially supporting the weight of said panels when folded in said stacked assembly, and d. counterbalance means for partially counterbalancing the weight of said stacked assembly comprising:

1. a lift cradle for engaging said panels when folded into said stacked assembly, 2. means for constraining movement of said lift cradle to a vertical plane, and 3. balance means having a frame attached to said storage cabinet and a pulling element attached to said lift cradle for exerting a lifting force thereto, e. said panels being disengaged from said cradle when said panels are positioned into said extended relation.

2. A folding cutting table and storage cabinet as set forth in claim 1 wherein said lifting force of said balance means varies as said panels are being selectively positioned from said folded relation to said extended relation.

* * * * *